US007470166B2

(12) United States Patent
Allen

(10) Patent No.: US 7,470,166 B2
(45) Date of Patent: Dec. 30, 2008

(54) TOY RACE TRACK

(76) Inventor: Christie L. Allen, 1911 Midway Rd., Strawberry Plains, TN (US) 37871

( * ) Notice: Subject to any disclaimer, the term of this patent is extended or adjusted under 35 U.S.C. 154(b) by 307 days.

(21) Appl. No.: 11/393,403

(22) Filed: Mar. 30, 2006

(65) Prior Publication Data

US 2007/0238537 A1 Oct. 11, 2007

(51) Int. Cl.
*A63H 33/08* (2006.01)
*A63H 33/00* (2006.01)

(52) U.S. Cl. ..... 446/108; 446/127; 446/487; 472/85

(58) Field of Classification Search ..... 446/79, 446/108, 124, 127, 227, 476, 478, 487; 472/85–87
See application file for complete search history.

(56) References Cited

U.S. PATENT DOCUMENTS 3,885,502 A * 5/1975 Sarno et al. ..... 104/53
5,212,842 A * 5/1993 Glydon ..... 5/420
6,761,563 B1 * 7/2004 Lin ..... 434/169
6,908,396 B1 6/2005 Billig

* cited by examiner

*Primary Examiner*—Kien T Nguyen
(74) *Attorney, Agent, or Firm*—Pitts & Brittian, P.C.

(57) ABSTRACT

A toy race track providing a mat for simulating a stock car racing track is disclosed. The toy race track includes a plurality of interlocking tiles having top and bottom surfaces. Each interlocking tile top surface includes top surface indicia depicting a portion of a stock car race track. Upon interlocking the tiles, the various top surface indicia cooperate to depict a complete stock car race track.

13 Claims, 6 Drawing Sheets

TOY RACE TRACK

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to toy race tracks. More particularly, this invention pertains to a mat marked to individualize and assimilate various race track designs.

2. Description of the Related Art

Toy vehicles, along with tracks, structures, play settings and accessory items have been a source of amusement for decades, particularly the types of toy vehicles and accessory items which provide some form of versatility in play situations. Numerous structures for use with toy vehicles have been developed, with such structures simulating race tracks, garages, firehouses, and the like. Such structures often depict scenes which are imaginatively engaging to the user, and which prompt the user to envision the toy vehicle interacting in a particular setting.

Likewise, automobile racing has been a form of entertainment for many people of all ages. In particular, stock car racing events produced by the National Association of Stock Car Auto Racing (NASCAR) have enjoyed widespread success as a spectator sport. Generally, the race tracks utilized by NASCAR in conducting various stock car racing events can be classified into one of six distinctive shapes: oval, tri-oval, quad-oval, oval with unequal ends, triangle, and complex road tracks. Oval tracks typically vary between 0.526 miles and 2.66 miles in length. A typical NASCAR racing surface includes several racing lanes, with a pit lane located along a straight portion of the race track. Several pit areas border the pit lane, each pit area being reserved for the racing team of a different stock car racing competitor. Various structures designated for spectator seating are typically disposed about the perimeter of the race track, with the interior land area reserved for stock car racing competitor teams and equipment.

Production of merchandise assimilating automobile racing equipment and teams has become a popular source of revenue for the automobile racing industry. Typical miniature toy cars bearing various NASCAR team indicia, such as those produced by the Hotwheels™ or Matchbox™ companies, are constructed on a scale of approximately 1:64 as compared to the actual, full-size vehicles. Each particular race track utilized by NASCAR in conducting various stock car racing events has become distinctively recognizable to many NASCAR enthusiasts. As a result, it is desirable to construct a miniature toy race track for use with miniature toy racecars which conforms to the specific markings and layout of a distinctive race track used in NASCAR stock car racing events.

BRIEF SUMMARY OF THE INVENTION

A toy race track providing a mat for simulating a stock car racing track is disclosed. The toy race track includes a plurality of interlocking tiles, with cooperating surface indicia. Each tile has a top surface and a bottom surface. Each top surface includes top surface indicia depicting a portion of a stock car race track. Upon interlocking the tiles, the various top surface indicia cooperate to depict a complete stock car race track. One embodiment provides bottom surface indicia depicting various scenes representative of a garage typically accessed by a conventional race car both before and after a racing event.

In another embodiment, a plurality of railing members is provided. Each of the plurality of railing members has a plurality of protrusions capable of interlocking with at least one of the plurality of interlocking tiles.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
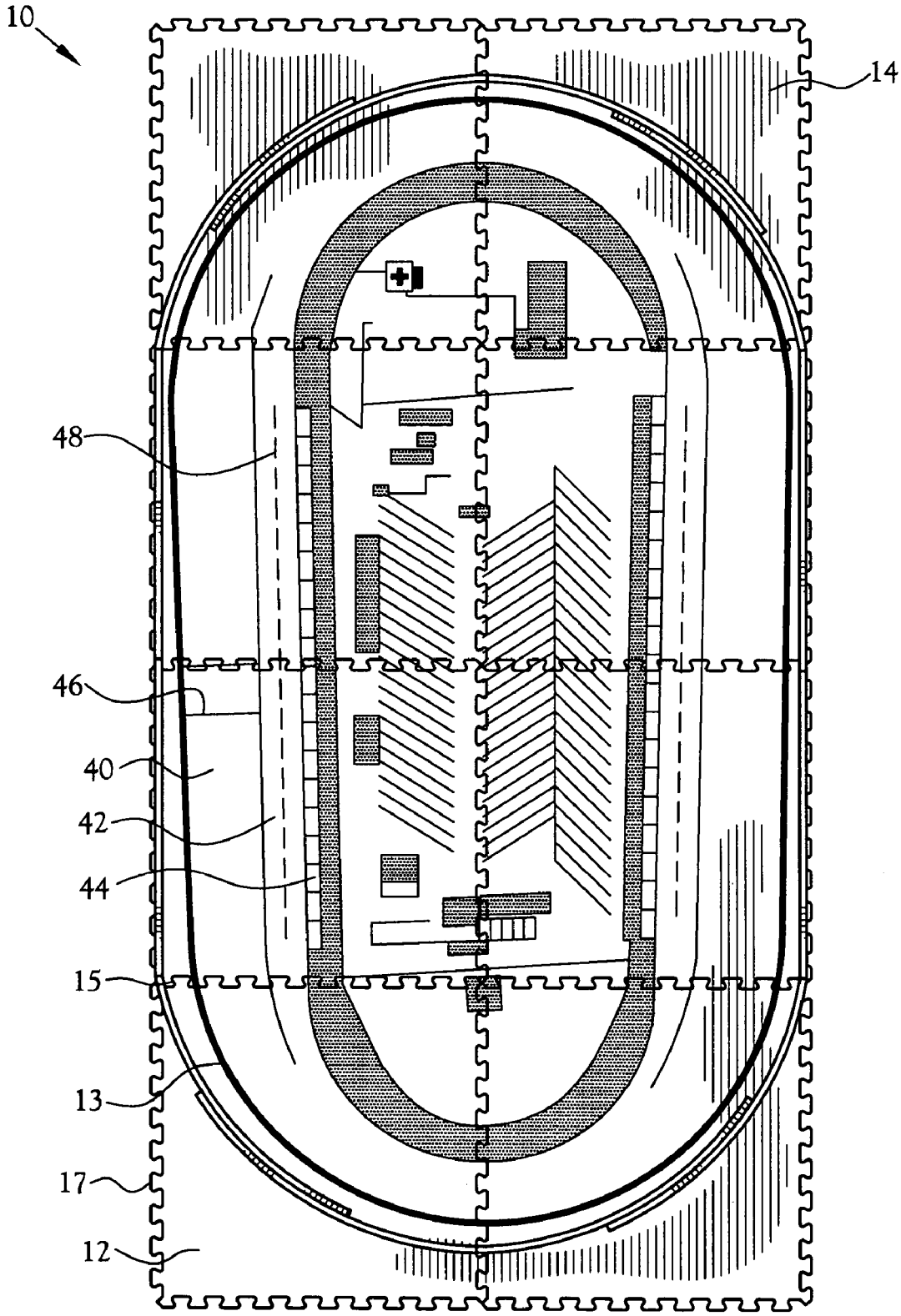
FIG. 1 is a top plan view of one embodiment of a toy race track constructed in accordance with several features of the present invention.

A toy race track providing a mat for simulating a stock car racing track is disclosed. The toy race track, illustrated at 10 in FIG. 1, includes a plurality of interlocking tiles 12, with cooperating top surface indicia 13. Each tile 12 has an interlocking perimeter 15 defined by a plurality of cogs 17. The cogs 17 cooperate to interlock with the cogs 17 of adjacent tiles. In one embodiment of the invention, the tiles 12 are fabricated from polymer foam. In another embodiment, the tiles 12 are fabricated from wood. Of course, those skilled in the art will recognize numerous other materials suitable for fabrication of the tiles 12.

Each tile 12 has a top surface 14 and a bottom surface 16. Each top surface 14 includes top surface indicia 13 depicting a portion of a stock car race track. Upon interlocking the tiles 12, the various top surface indicia 13 cooperate to depict a complete stock car race track. As shown in FIG. 1, the various top surface indicia 13 of the present embodiment depict generally a racing traffic lane 40, a pit row 42, and a plurality of pit areas 44. The racing traffic lanes 40 include a starting line 46, and the pit row 42 includes a dashed line 48 to indicate a two-lane road. Those skilled in the art will appreciate that numerous other depictions may be added to or subtracted from the top surface indicia 13 to accomplish the toy race track 10 of the present invention.

In the present embodiment of FIG. 1, the toy race track 10 includes eight interlocking tiles 12. Top surface indicia 13 of the eight interlocking tiles 12 cooperate to depict a top plan view of a NASCAR race track such as the Bristol Motor Speedway race track located in Bluff City, Tenn. In another embodiment, top surface indicia 13 of ten interlocking tiles 12 cooperate to depict a top plan view of a NASCAR race track such as the Watkins Glen International race track located in Watkins Glen, N.Y. Of course, those skilled in the art will recognize numerous other race track designs suitable for depiction by the toy race track 10. To this extent, it is appreciated that the exact number and configuration of interlocking tiles 12, and the configuration of corresponding top surface indicia 13, depends largely on the particular race track to be assimilated by the toy race track 10. It is also appreciated that the toy race track 10 may be configured to depict any number of oval shaped tracks, tri-oval shaped tracks, quad-oval shaped tracks, oval shaped tracks with unequal ends, triangle shaped tracks, and complex road tracks, as well as numerous other shapes and configurations of race tracks, without departing from the spirit and scope of the present invention.

Figure 2:
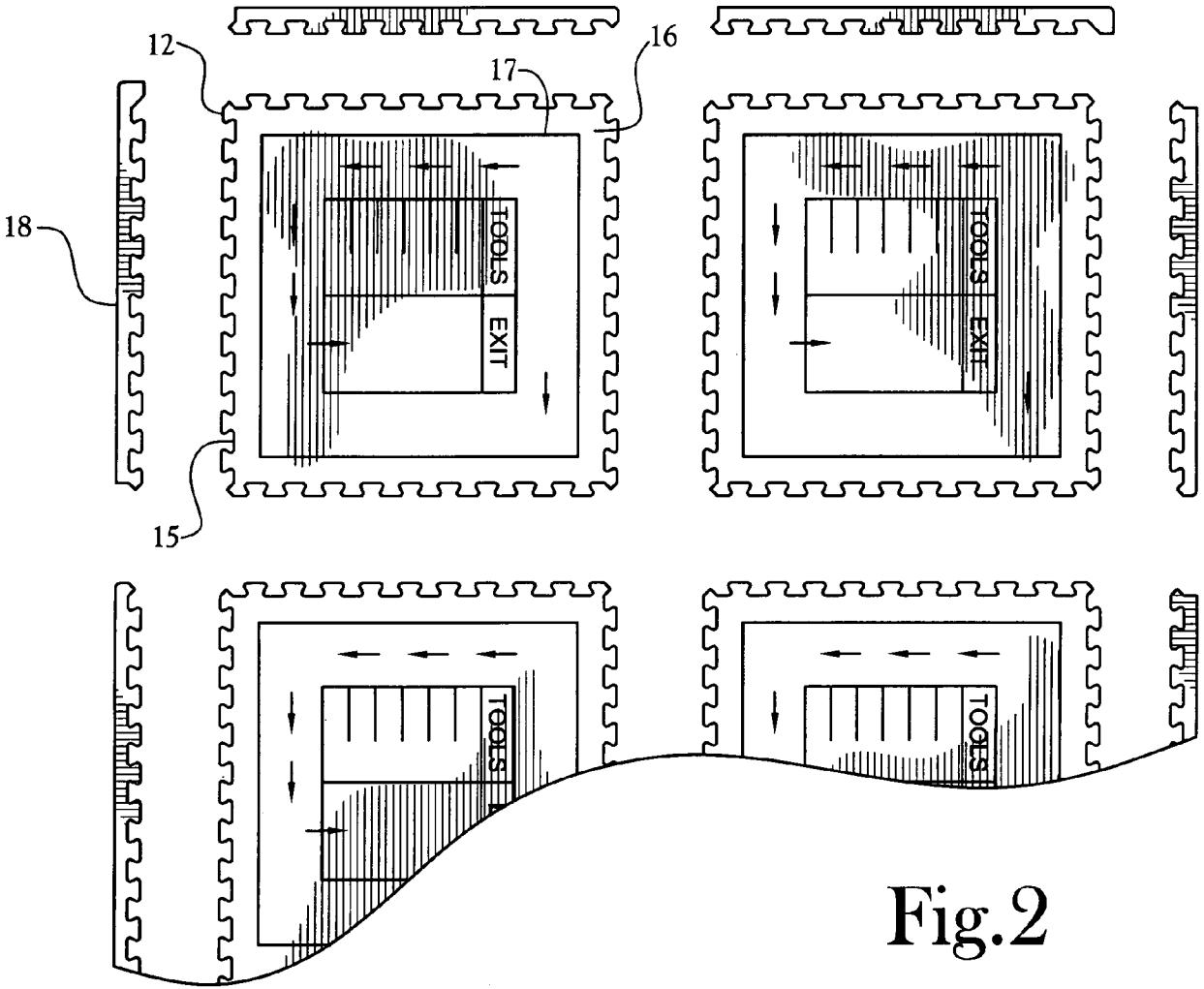
FIG. 2 is an exploded bottom view of the toy race track of FIG. 1.

FIG. 2 is an exploded bottom view of the toy race track 10 of FIG. 1. As shown in FIG. 2, in one embodiment, each bottom surface 16 includes bottom surface indicia 17 depicting the layout of a standard mechanic's garage. In this configuration, the user is able to invert a selected tile 12 to expose the individual bottom surface 16 of the tile 12. With the bottom surface 16 exposed, the user is able to access the bottom surface indicia 17 and engage the bottom surface indicia 17 with a toy car (not shown). In the present, embodiment, each of the various bottom surfaces 16 of each of the eight tiles 12 include bottom surface indicia 17 encompassing a different color theme, each color theme corresponding to the traditional color theme of a NASCAR racing team. The user is thus able to assign each toy car to a particular bottom surface 16 in order to envision a competitive racing environment. In another embodiment, each of the various bottom surfaces 16 of each of the eight tiles 12 includes bottom surface indicia 17 encompassing similar color themes. In yet another embodiment, the various bottom surfaces 16 include varying bottom surface indicia 17. In this embodiment, one bottom surface 16 depicts the layout of a standard parking area, another bottom surface 16 depicts a standard racing pit area, and other bottom surfaces 16 depict surrounding areas typically found in the periphery of an automobile race track. From the foregoing description, it will be recognized by those skilled in the art that bottom surface indicia 17 depicting various scenes typically accessed by a conventional race car both before and after a racing event is provided. As such, it is appreciated that bottom surface indicia 17 depicting any such scenes can be used without departing from the spirit and scope of the present invention.

Figure 3A:
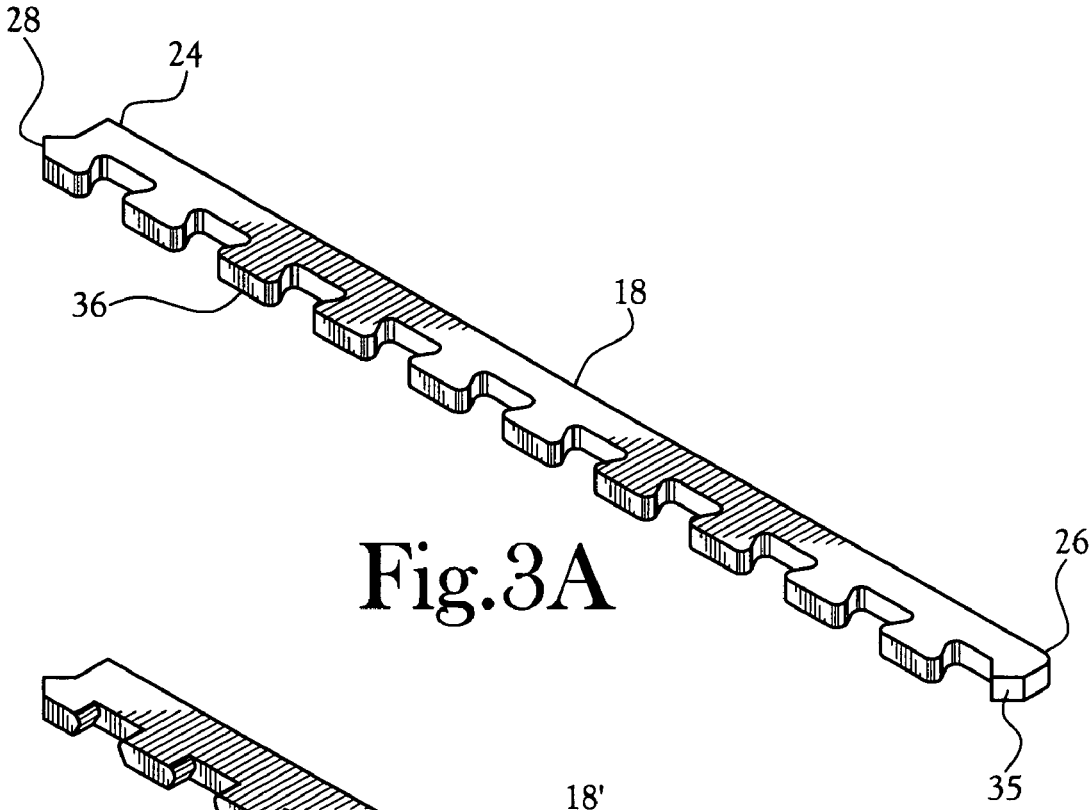
FIG. 3A is a perspective view showing a railing member constructed in accordance with several features of the present invention.

In one embodiment, a plurality of railing members 18 is provided. As shown in FIG. 3A, each railing member 18 has a first end 24 and a second end 26. The second end 26 of each railing member 18 is adapted to overlap with the first end 24 of a juxtaposed railing member 18. In the illustrated embodiment, each first end 24 has a tooth 28, and each second end 26 defines a cavity 35 adapted to overlap a tooth 28 from a first end 24. Of course, those skilled in the art will recognize other configurations suitable for fitting the various first ends 24 of the plurality of railing members 18 to various second ends 26 of adjacent railing members 18. Furthermore, it is understood by one skilled in the art that inclusion of the railing members 18 is not necessary to accomplish the toy race track 10 of the present invention.

Figure 3B:
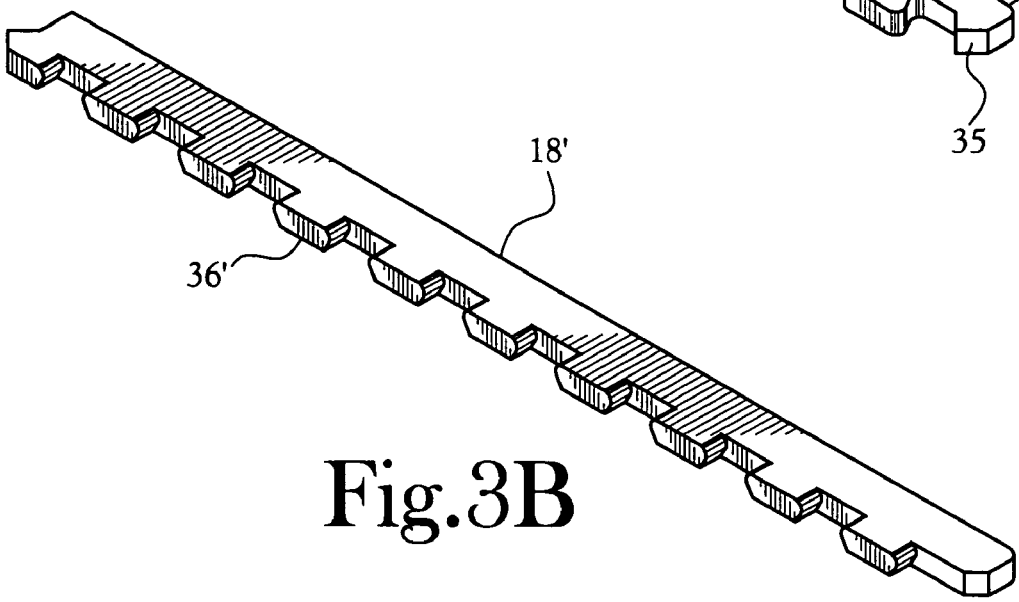
FIG. 3B is a perspective view showing another embodiment of a railing member constructed in accordance with several features of the present invention.
Figure 4:
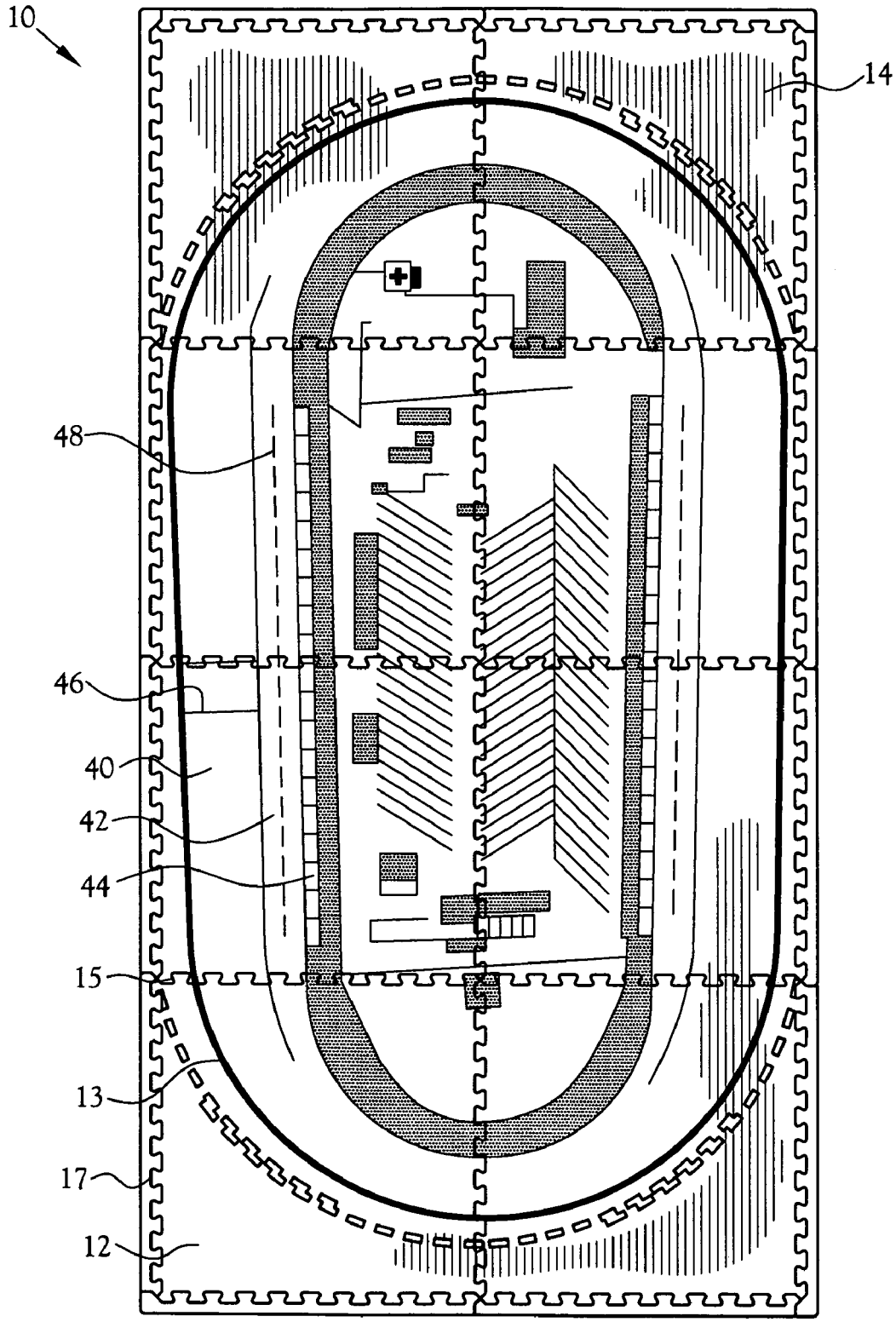
FIG. 4 is a top plan view of the toy race track of FIG. 1, showing the railing members secured to the tiles in a substantially coplanar configuration.

Each railing member 18 includes a plurality of protrusions 36. The various protrusions 36 are adapted to interlock with the interlocking perimeter 15 of at least one tile 12 to secure the railing member 18 to the tile 12. In the embodiment of FIG. 3A, each railing member 18 is constructed from a resiliently deformable material, such as polymer foam, rubber, or another suitable material. As illustrated in FIG. 4, the protrusions 36 are keyed to the interlocking perimeter 15 of the tile 12 such that the railing member 18 is securable to the tile 12 in a substantially coplanar fashion. In this configuration, the railing members 18 cooperate with the tiles 12 to form a substantially continuous mat. Referring to FIGS. 1 and 4, the deformability of the protrusions 36 allows a user to selectively manipulate the railing members 18 to reposition the railing members 18 from a configuration substantially coplanar to the tile 12 to a configuration substantially perpendicular to the tile 12. Another embodiment of a railing member 18' suitable for use in the present invention is illustrated in FIG. 3B. In this embodiment, the protrusions 36' are keyed to the interlocking perimeter 15 of the tile 12 such that the railing member 18' is securable to the tile 12 in a substantially perpendicular fashion. Based on the foregoing, those skilled in the art will appreciate that other means of allowing the railing member 18 to be selectively positionable from a substantially coplanar configuration to a substantially perpendicular configuration proximate the tile 12 exist. Therefore, such means may be used without departing from the spirit and scope of the present invention.

Figure 5A:
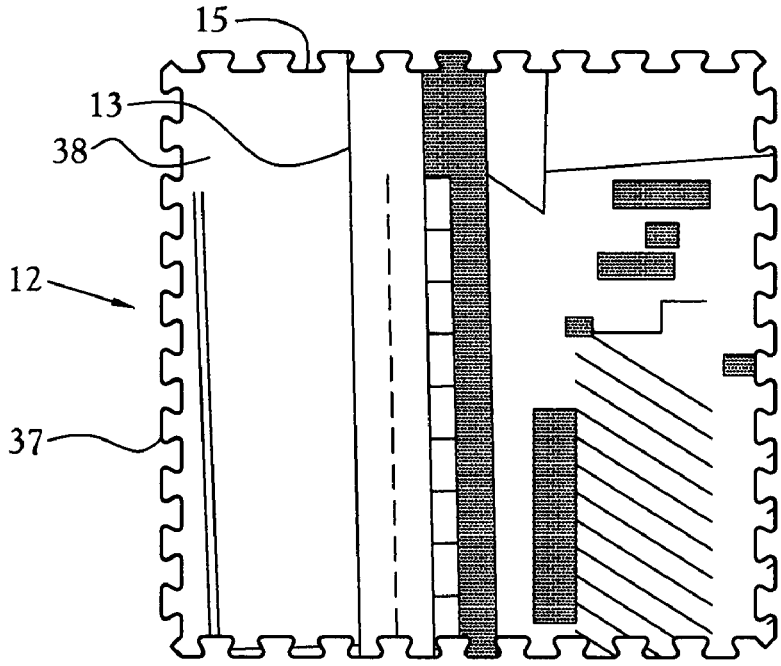
FIG. 5A is a top plan view of a typical straightaway tile of the toy race track.
Figure 5B:
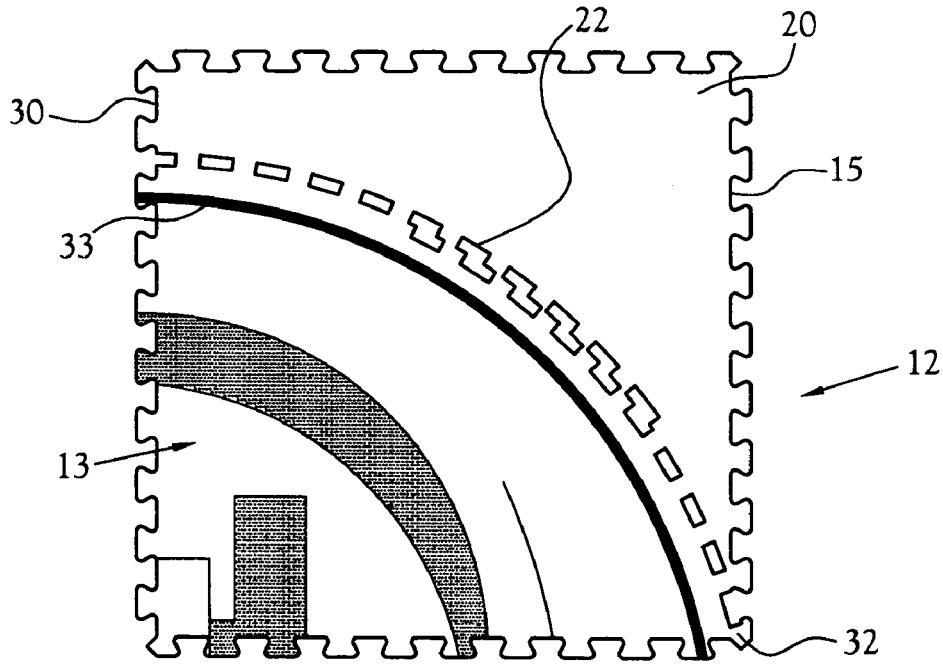
FIG. 5B is a top plan view of a typical curving tile of the toy race track.

FIGS. 5A and 5B illustrate top plan views of two types of tiles 12 constructed in accordance with several features of the present invention. As is shown in FIG. 5A, a straightaway tile 38 includes top surface indicia 13 depicting a straight segment of a stock car race track. The railing member 18 corresponding to a straightaway tile 38 has protrusions 36 that are adapted to interlock with a single side of the interlocking perimeter 15, specifically, a side 37 corresponding to the outer edge of the stock car race track. FIG. 5B shows a curving tile 20, including top surface indicia 13 depicting a curved segment of a stock car race track. In the illustrated embodiment, each curving tile 20 defines a plurality of openings 22. The various openings are arranged in a substantially arced configuration from a first edge 30 of the curving tile 20 to a second edge 32 of the curving tile 20, along the exterior perimeter 33 of the race track curved segment. In another embodiment, the various openings are arranged in a single arc spanning from the first edge 30 to the second edge 32. Those skilled in the art will recognize other configurations for the plurality of openings 22 suitable for use in the present invention.

Figure 6:
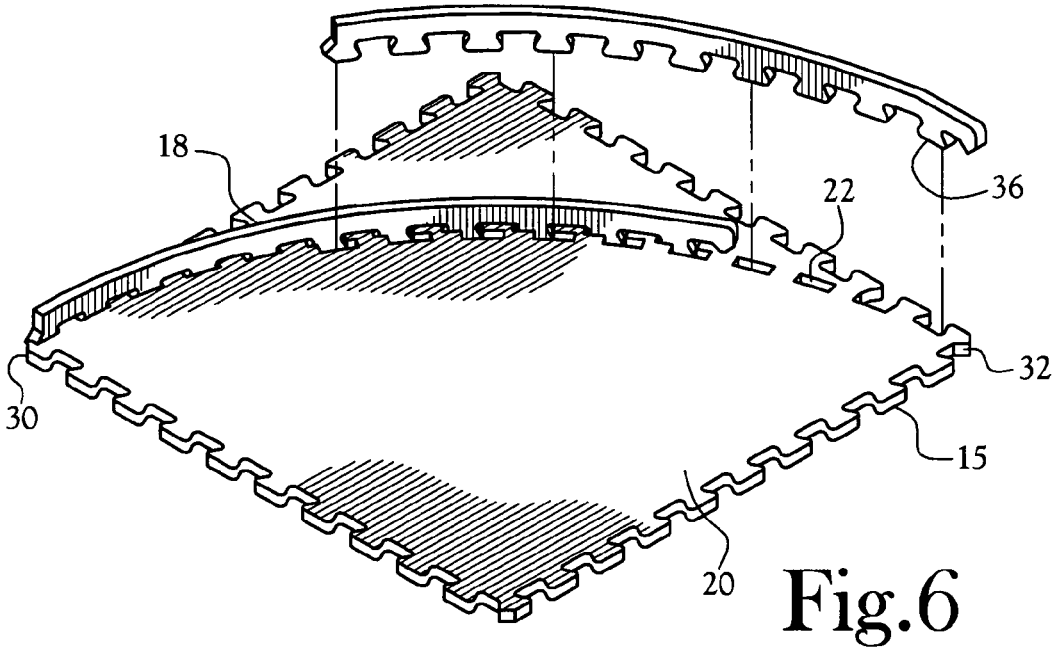
FIG. 6 is a perspective view of a curving tile, showing one railing member secured to the curving tile and a second railing member exploded from the curving tile.

Each of the plurality of openings 22 is adapted to receive a protrusion 36 of a railing member 18. In this configuration, the railing member 18 corresponding to a curving tile 20 is secured to the curving tile 20 offset from that portion of the interlocking perimeter 15 corresponding to the exterior of the curved race track segment. FIG. 6 is a perspective view of the curving tile 20, showing one railing member secured to the curving tile 20 and a second railing member exploded upward from the curving tile 20. In the illustrated embodiment, each railing member 18 has an approximate length equal to the length of a single side of the curving tile 20. In this embodiment, each opening 22 is adapted to receive one protrusion 36 from one of two railing members 18. In this configuration, each railing member 18 is secured to the curving tile 20 in an overlapping configuration to allow the railing members 18 to cooperate to span from the first edge 30 to the second edge 32 along the arced configuration, offset from the interlocking perimeter 15.

Figure 7:
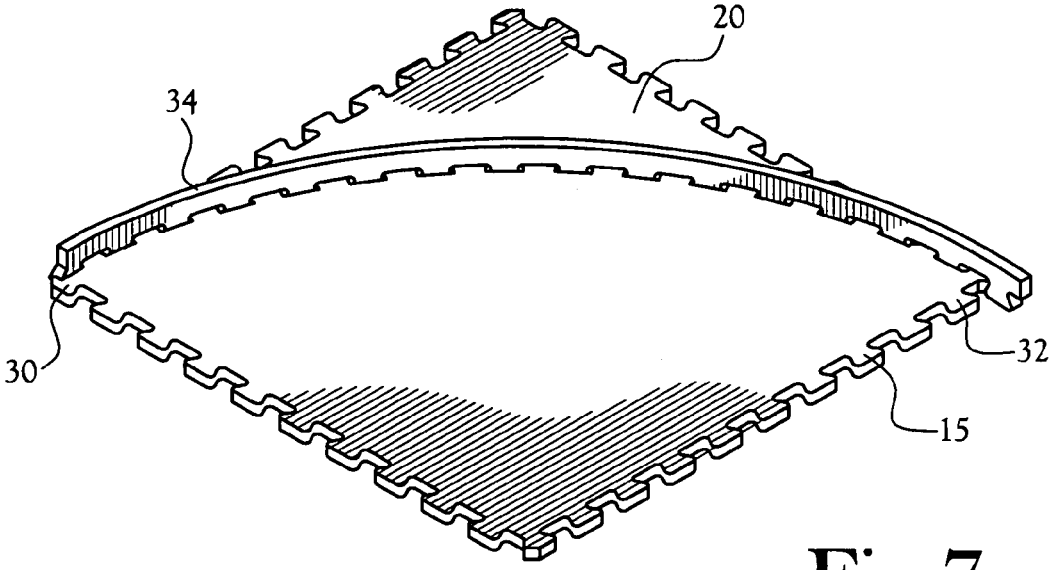
FIG. 7 is a perspective view of another embodiment of a curving tile, showing a single railing member secured to the curving tile.

FIG. 7 illustrates an additional embodiment of a curving tile 20 utilizing a single corner rail 34 for each curving tile 20. In the embodiment of FIG. 7, each corner rail 34 is of sufficient length to span from the first edge 30 of the curving tile 20 to the second edge 32 of the curving tile 20 along the arced configuration. Those skilled in the art will recognize other suitable configurations for the railing members 18, 34 along the curving tile 20 that may be used without departing from the spirit and scope of the present invention.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A toy race track simulating a stock car racing arena, said toy race track comprising:

a mat including a plurality of interlocking tiles, each of said plurality of interlocking tiles having a top surface, a bottom surface, and an interlocking perimeter, at least one of said plurality of interlocking tiles defining a plurality of openings offset from said interlocking perimeter; and, a plurality of railing members, each of said plurality of railing members having a plurality of protrusions capable of interlocking with at least one of said plurality of interlocking tiles proximate said interlocking perimeter, said plurality of railing members having at least one length adapted to be received by said plurality of openings such that said at least one length is offset from said interlocking perimeter.

2. The toy race track of claim 1, each of said top surfaces of said plurality of interlocking tiles having indicia depicting a portion of a stock car race track, whereby upon interlocking said plurality of interlocking tiles, each of said first surfaces cooperate to depict a miniature stock car race track.

3. The toy race track of claim 1, said plurality of railing members being constructed from a resiliently deformable material, said plurality of protrusions being keyed to said interlocking perimeter such that each of said railing members is securable to at least one of said plurality of interlocking tiles in a substantially coplanar fashion, each of said plurality of railing members being selectively positionable to a configuration substantially perpendicular to at least one of said plurality of interlocking tiles.

4. The toy race track of claim 1, said plurality of protrusions being keyed to said interlocking perimeter such that each of said railing members is securable to at least one of said plurality of interlocking tiles substantially perpendicular to said at least one interlocking tile.

5. The toy race track of claim 1, each of said bottom surfaces having indicia marking the layout of a garage.

6. The toy race track of claim 1, each of said bottom surfaces having indicia marking the layout of a garage, each of said bottom surface indicia encompassing a color theme corresponding to the color theme of a NASCAR racing team.

7. The toy race track of claim 1, each of said bottom surfaces having indicia marking the layout of a parking area.

8. The toy race track of claim 1, said plurality of interlocking tiles including at least one curving tile, said curving tile defining a plurality of openings arranged in a substantially arced configuration from a first edge of said curving tile to a second edge of said curving tile;

whereby each of said plurality of openings is adapted to receive at least one of said plurality of protrusions.

9. The toy race track of claim 1, said plurality of interlocking tiles including at least one curving tile, said curving tile defining a plurality of openings, arranged in a configuration of at least two substantially overlapping arcs, said plurality of openings being disposed between a first edge of said curving tile and a second edge of said curving tile;

whereby each of said plurality of openings is adapted to receive at least one of said plurality of protrusions such that at least two of said plurality of railing members are positionable along said plurality of openings in a substantially overlapping configuration.

10. The toy race track of claim 8, at least one of said top surface indicia further depicting:

at least one racing traffic lanes;

a pit row disposed proximate said plurality of racing traffic lanes; and, a plurality of pit areas.

11. A toy race track simulating a stock car racing arena, said toy race track comprising:

a mat including a plurality of interlocking tiles, each of said plurality of interlocking tiles having a top surface, a bottom surface, and an interlocking perimeter, each of said top surfaces having indicia depicting a portion of a stock car race track, each of said bottom surfaces having indicia marking the layout of a garage, said plurality of interlocking tiles including at least one curving tile, said curving tile defining a plurality of openings arranged in a configuration of at least two substantially overlapping arcs, said plurality of openings being disposed between a first edge of said curving tile and a second edge of said curving tile, at least one of said top surface indicia further depicting:

at least one racing traffic lane;

a pit row disposed proximate said plurality of racing traffic lanes; and, a plurality of pit areas; and, a plurality of railing members, each of said plurality of railing members having a plurality of protrusions capable of interlocking with at least one of said plurality of interlocking tiles proximate said interlocking perimeter;

whereby each of said plurality of openings is adapted to receive at least one of said plurality of protrusions such that at least two of said plurality of railing members are positionable along said plurality of openings in a substantially overlapping configuration, and whereby upon interlocking said plurality of interlocking tiles, each of said first surfaces cooperate to depict a miniature stock car race track.

12. The toy race track of claim 1, said plurality of protrusions being keyed to said interlocking perimeter such that each of said railing members is securable to at least one of said plurality of interlocking tiles substantially perpendicular to said at least one interlocking tile.

13. The toy race track of claim 1, said plurality of railing members being constructed from a resiliently deformable material, said plurality of protrusions being keyed to said interlocking perimeter such that each of said railing members is securable to at least one of said plurality of interlocking tiles in a substantially coplanar fashion, each of said plurality of railing members being selectively positionable to a configuration substantially perpendicular to at least one of said plurality of interlocking tiles.

* * * * *